US009868554B2

(12) United States Patent
Grappoli

(10) Patent No.: US 9,868,554 B2
(45) Date of Patent: Jan. 16, 2018

(54) CENTERING DEVICES FOR CARRIER PACKERS

(71) Applicant: APE IMPIANTI S.r.l., Negrar (Verona) (IT)

(72) Inventor: Franco Grappoli, Verona (IT)

(73) Assignee: APE IMPIANTI S.R.L., Negrar (Verona) (IT)

( * ) Notice: Subject to any disclaimer, the term of this patent is extended or adjusted under 35 U.S.C. 154(b) by 447 days.

(21) Appl. No.: 14/713,042

(22) Filed: May 15, 2015

(65) Prior Publication Data

US 2016/0332758 A1 Nov. 17, 2016

(51) Int. Cl.
*B65B 39/00* (2006.01)
*B65B 21/18* (2006.01)

(52) U.S. Cl.
CPC ..... *B65B 39/006* (2013.01); *B65B 21/18* (2013.01)

(58) Field of Classification Search
CPC ..... B65B 21/00; B65B 21/02; B65B 21/04; B65B 21/06; B65B 21/14; B65B 21/16; B65B 21/18; B65B 39/006; B65B 43/54
USPC ..... 53/48.1, 142, 158, 539, 247, 248, 262, 53/263; 493/312
See application file for complete search history.

(56) References Cited

U.S. PATENT DOCUMENTS 2,540,743 A * 2/1951 Leach ..... B65B 39/006 53/248
2,686,623 A 8/1954 Wimmer et al.
2,753,673 A 7/1956 Olive
3,673,756 A * 7/1972 Prete et al. ..... B65B 39/007 53/247
3,928,942 A * 12/1975 Paddock et al. ..... B65B 25/046 53/247
4,215,521 A * 8/1980 Hartness ..... B65B 39/006 53/248
4,569,181 A 2/1986 Raudat
4,570,413 A * 2/1986 Raudat ..... B65B 39/006 53/247
4,843,797 A * 7/1989 Butterly, Jr. et al. ... B65B 21/18 198/418.1
5,212,930 A * 5/1993 Raudat ..... B65B 21/08 53/246
5,212,932 A * 5/1993 Raudat ..... B65B 39/006 53/247
5,588,282 A * 12/1996 Hartness ..... B65B 21/183 53/248
7,107,742 B2 * 9/2006 Blanc ..... B65B 5/105 53/153

FOREIGN PATENT DOCUMENTS

GB 1388987 A 4/1975

* cited by examiner

*Primary Examiner* — Stephen F Gerrity
(74) *Attorney, Agent, or Firm* — Robert E. Alderson, Jr.

(57) ABSTRACT

Centering devices for carrier packers are provided. Such devices may include two series of flexible tabs, aligned along two parallel shafts. The shafts rotate the flaps in two alternative angular positions. In a lowered angular position, the tabs are introduced partly in the cells of a carrier, to guide bottles towards the centers of the cells. In an angularly raised position, the tabs are rotated away so as not to interfere with the bottle necks once the bottles have been fitted in the cells, so that it is convenient for a conveyor to take away the carrier. Carrier packers including such devices are also provided.

9 Claims, 17 Drawing Sheets

CENTERING DEVICES FOR CARRIER PACKERS

FIELD OF THE INVENTION

The present invention relates generally to carrier packers, that is machines for placing articles, typically bottles, in carriers or cartons, in a predetermined array. More specifically, this invention relates to devices for centering and guiding articles such as bottles to be loaded into upwardly open packing cases.

BACKGROUND OF THE INVENTION

In a carrier packer, articles such as bottles or cans are continuously supplied to the packer by a conveyor. The moving bottles are formed into a predetermined number of parallel lines, typically two, three or four lines. The lines are separated in lanes, spaced apart by lane dividers. The bottles are fed into the respective lanes by the movement of a conveyor. The conveyor feeds the bottles into an array-forming section where the bottles are grouped into a desired pattern for packing. This array, that is the number of lines and the number of bottles in each line, corresponds to the particular carrier into which the bottles are to be packed. A carrier will generally have an outer paperboard box and inner grid-like partitions which subdivide the space within the carrier into upwardly open compartments or cells where the bottles are fitted individually.

A transfer device grips an array of bottles and drops them in an upright position into the carrier. As they drop, the bottles are guided toward and into the respective cells, between the partitions of the carrier, by an intermediate grid having a number of flexible fingers or flaps around the fall path of each bottle, which funnels the bottle into its particular cell within the carrier.

Such devices are provided with flexible members for directing the bottles being dropped from a gripping assembly into particular locations within the container. Finger assembles or clusters are generally mounted to parallel rails in a vertically movable grid assembly, either at the sides of individual passages for the bottles, or at the corners of square passageways for the bottles. With conventional finger assemblies, it may happen that the fingers will catch against the upper edges of the partitions, thus causing the entire production line to stop.

SUMMARY OF THE INVENTION

A primary object of the invention is to improve the performance of a carrier packer. In particular, it is desired to speed up the cycles of loading or filling of the carriers and eliminate down times due to failures of the loading device. A specific object of the invention is to provide highly reliable centering devices which are simple in construction.

The above and other objects and advantages which will be better understood herein after, are achieved, according to the invention, by centering devices having features described and claimed herein.

In summary, centering devices may be installed at loading or filling stations in a carrier packer or packing machine, where groups or arrays of bottles or other containers are placed in carriers each having two rows of upwardly open cells. To guide the downward movement towards the center of each cell, in representative embodiments there are provided two series of flexible tabs, aligned along two respective rotatable shafts. The shafts are mounted on two opposite sides of the loading station, from where a conveyor belt carries away the carriers once they have been filled. The two shafts are rotatable in order to rotate simultaneously all the flaps between two alternative angular positions. In a lowered angular position, the tabs are introduced partly in the top parts of the carrier cells, to guide the individual articles (bottles or cans or other containers) towards the center of the respective cells. In an angularly raised position, the tabs are rotated so as not to interfere with the articles, in particular with bottle necks, once the bottles have been located in the cells, so that a conveyor may take the carrier away.

BRIEF DESCRIPTION OF THE FIGURES

There will now be described particular embodiments, given by way of example, reference being made to the accompanying drawings briefly described below.

DETAILED DESCRIPTION

Figure 1:
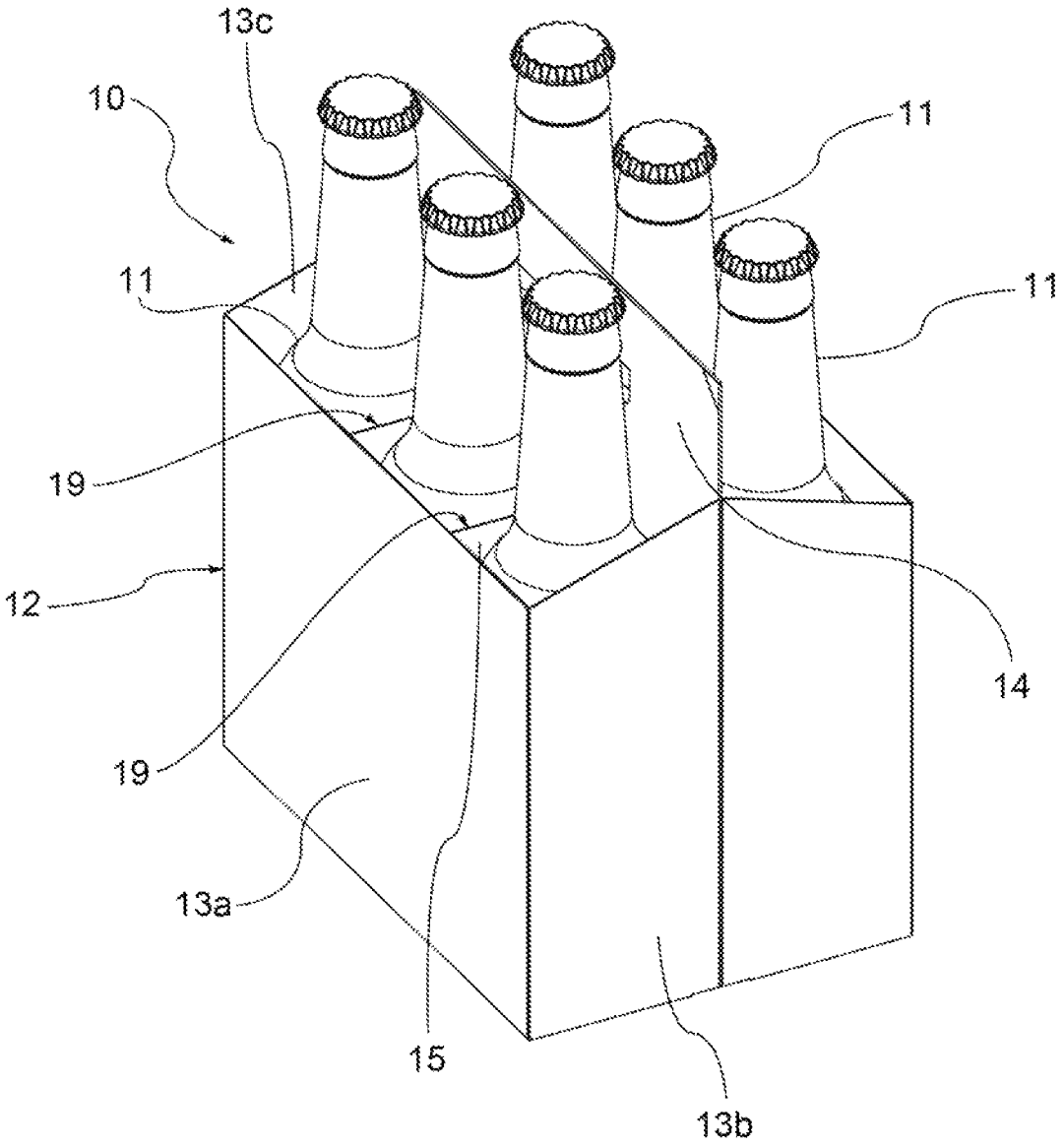
FIG. 1 is a perspective view of a package comprising a carrier with six bottles.
Figure 2:
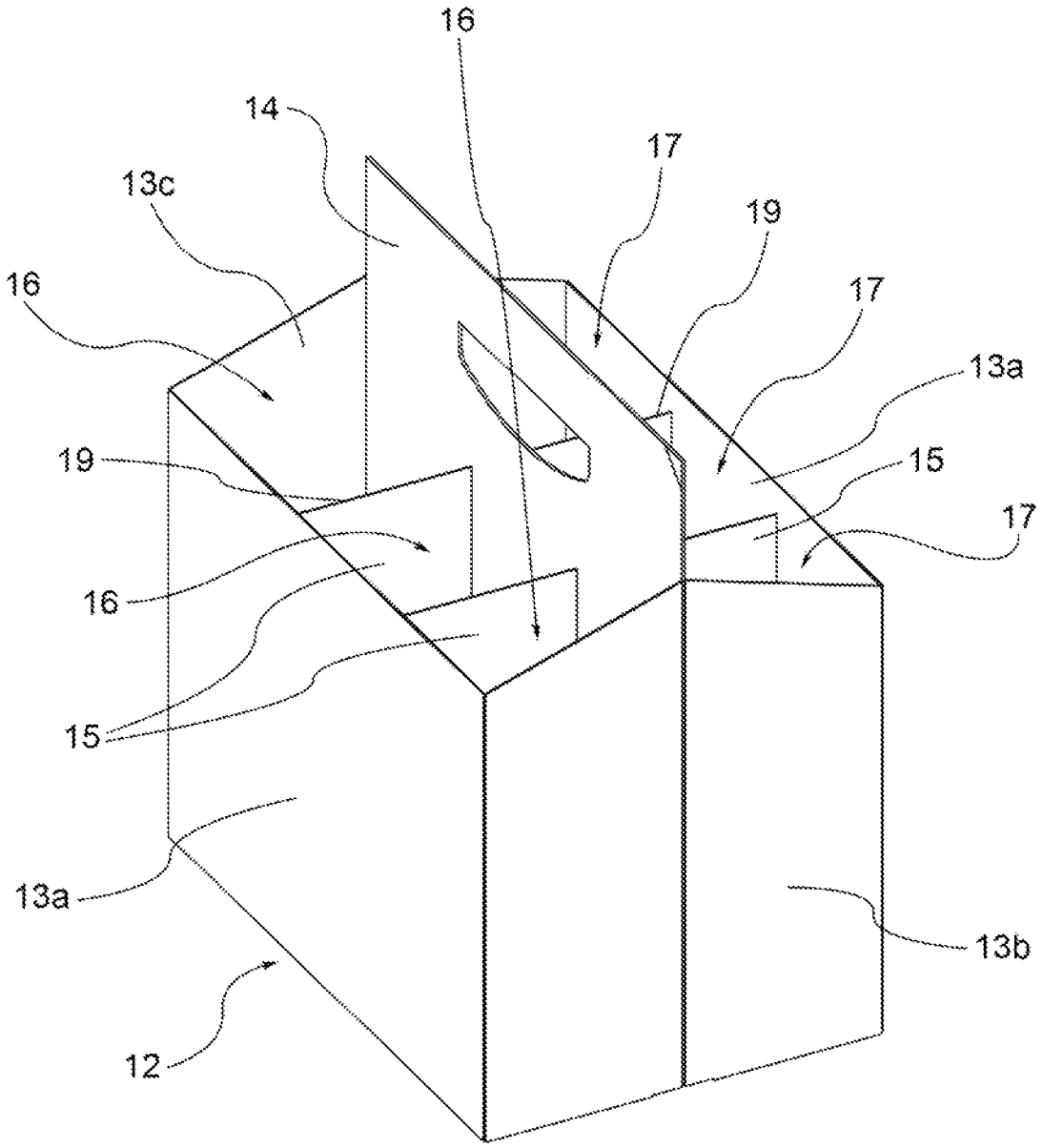
FIG. 2 is a perspective view of the carrier of FIG. 1, in an empty condition.

Referring initially to FIGS. 1 and 2, with the number 10 designating as a whole a package of containers 11, in this example bottles, inserted in a carrier 12, typically of cardboard. This embodiment refers to a carrier containing two rows of three bottles each. The carrier 12 has an upwardly open outer box 13 with a rectangular base, with a wall or vertical median partition 14 that extends in a direction defined herein as "longitudinal", and one or more internal walls or partitions 15 parallel to one another and extending in a transverse direction. The partitions 14, 15 define, within the carrier, two parallel rows of upwardly open cells or receptacles 16, 17 each suitable for accommodating a respective bottle. Designated at 19 are upper edges of the transversal partitions 15. The outer box has two pairs of vertical side walls 13*a*, a transversal vertical front wall 13*b* and a transversal vertical rear wall 13*c*.

The number of bottles and corresponding cells in each row may be greater or less than three. There may be, for example, two, or four, or more than four cells. The material which the carrier is made of may be paperboard or cardboard. However, other materials may be used as well. For example, the carrier may be made of plastic material. The container 11 need not necessarily be a bottle. As alternatives, the containers 11 may be cans, flasks, or other containers, typically containers for liquids.

Figure 3:
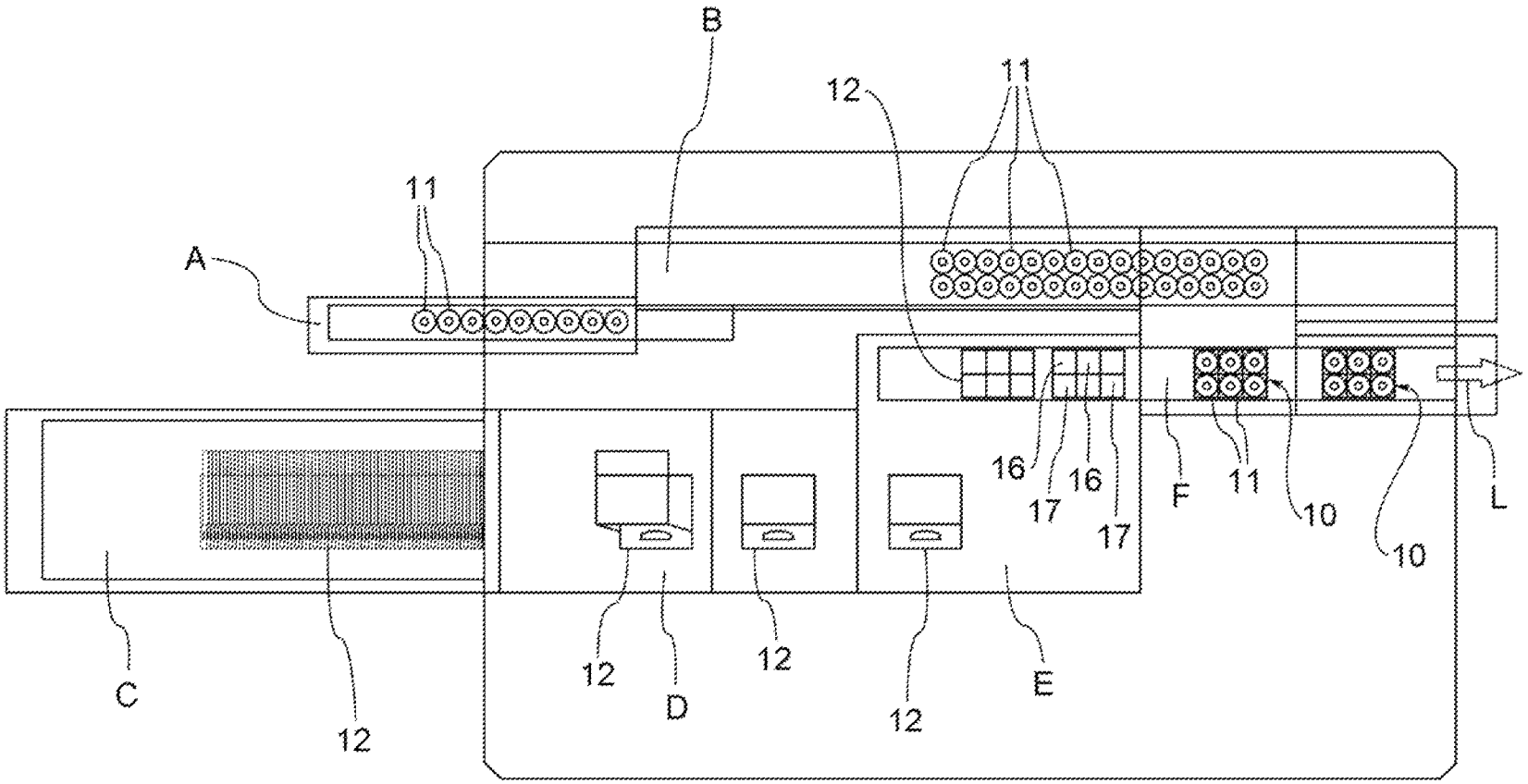
FIG. 3 is a schematic plan view of a carrier erector and packer, which can incorporate a centering device according to the present invention.
Figure 4:
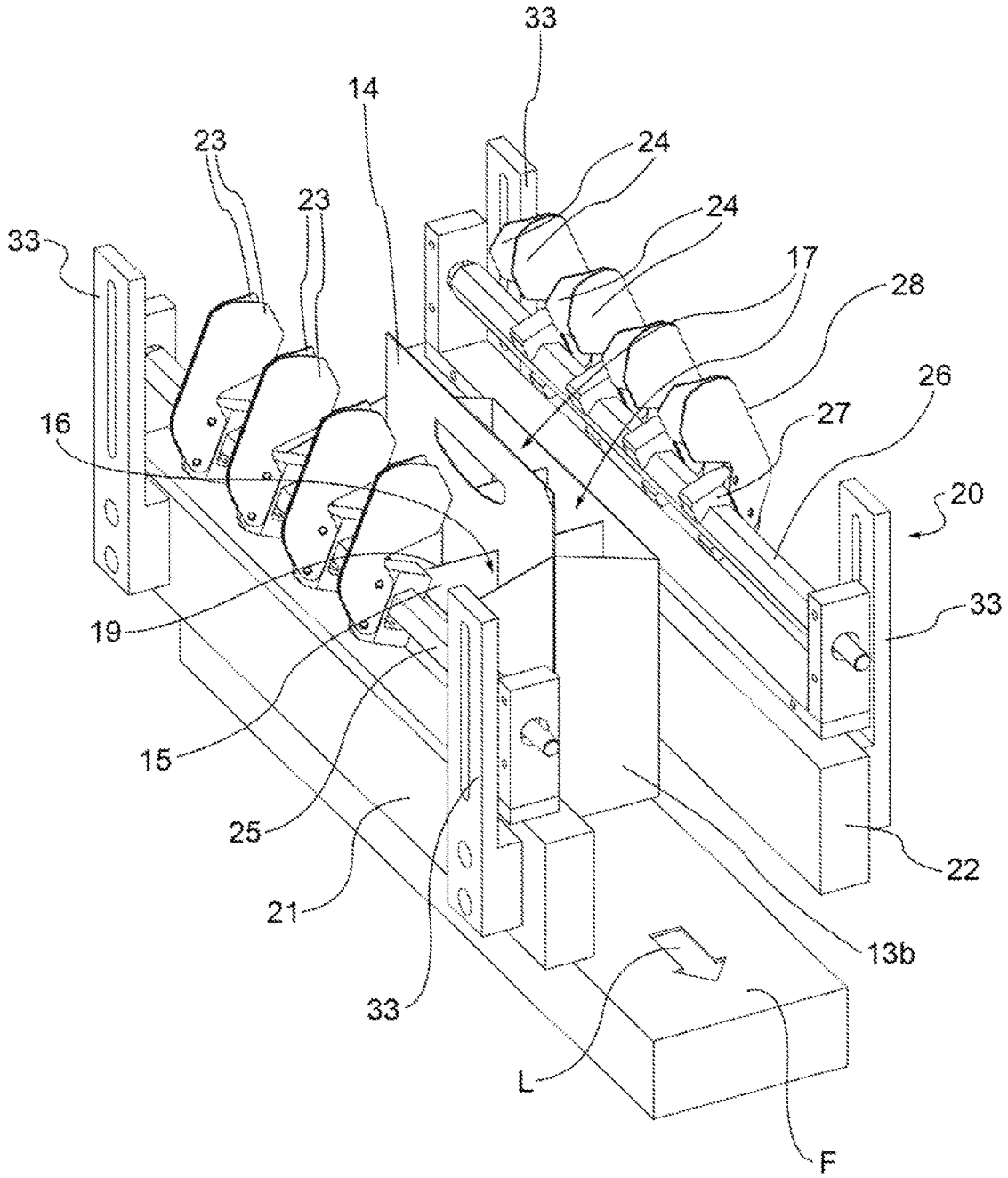
FIGS. 4, 5 and 6 are respectively, a perspective view, a top view and a front view of an empty carrier and a centering device with its tabs in a raised position.
Figure 10:
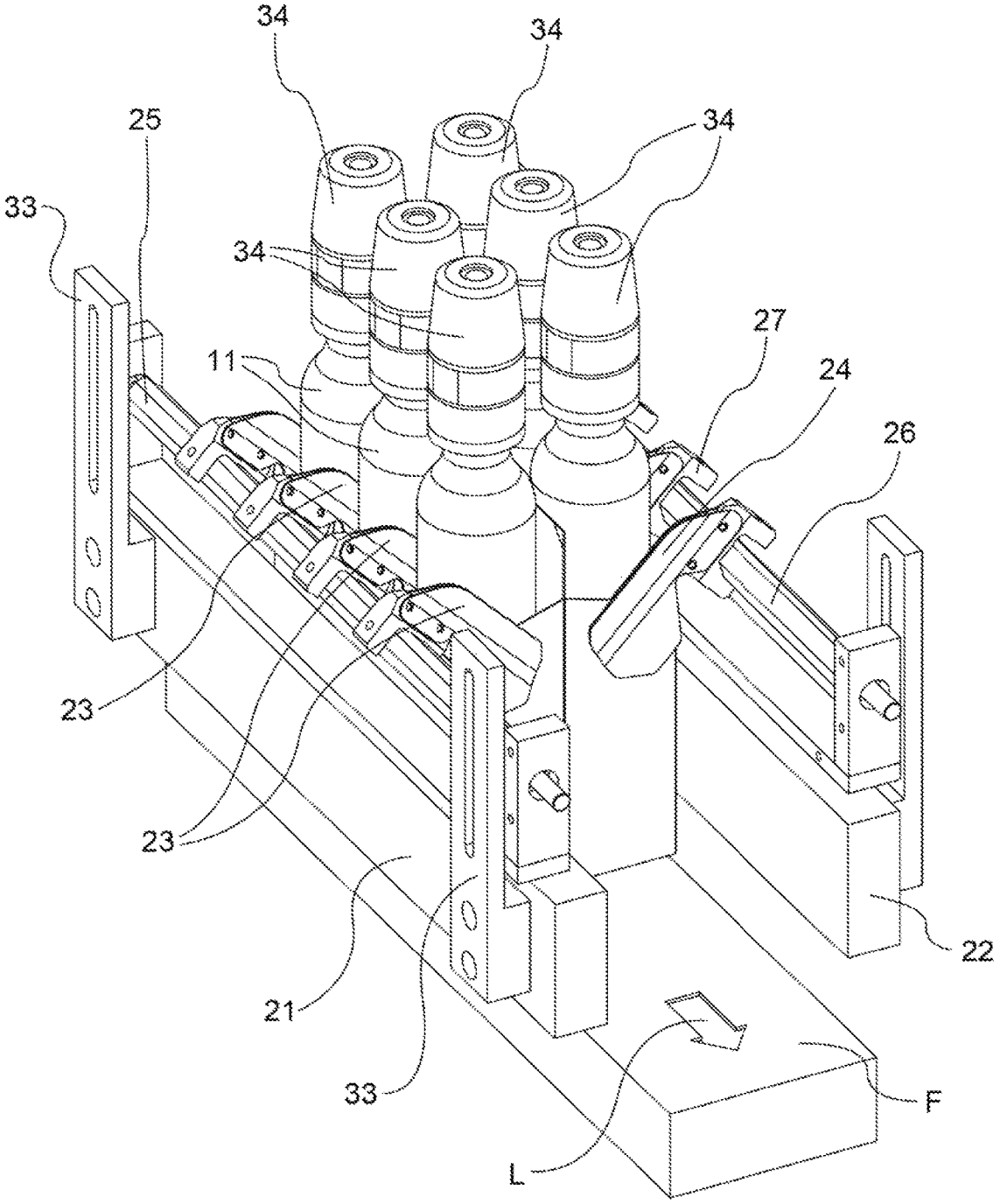
FIGS. 10, 11 and 12 are perspective views showing bottles being fitted in the carrier.

Shown in FIG. 4 is a centering device, designated as a whole at 20, which serves to direct the bottles that are dropped or deposited by a gripping device (designated as 34 in FIG. 10) in respective cells 16, 17 of the carrier. The centering device 20 can be inserted in a machine schematically illustrated in plan view in FIG. 3, in this example carrier erector and packer, i.e. a machine which forms the carriers erecting them from folded blanks and fills the carriers with articles such as bottles or other containers.

The general characteristics of a carrier packing machine are known in the art. Consequently, in the present specification the elements of specific importance for the purposes of implementing the invention will be described in detail. For the construction of parts and elements not shown in detail, reference may be made to any carrier packer of known design.

As shown in FIG. 3 a carrier erector and packer includes a bottle input zone A, from where the bottles are sorted and arranged in two parallel rows in a bottle sorting and gathering zone B. The bottles are handled in an upright position, carried on conveyor belts. The carriers 12 are formed from a store C where the carriers are initially stacked in a closed or flattened condition. By means of conventional devices, the carriers are taken one by one from the store C, opened in an opening area D, and taken in a carrier preparation E located to the left of a conveyor belt F which advances in a longitudinal direction of advancement L. The carriers are placed in an upstream area on the conveyor belt F and are transferred in a row by the belt F to a packing station G located transversely to the left of the bottle sorting and gathering area B.

A gripping and transferring device 34 (FIG. 10), picks up a group or array of six bottles 11 from the bottle sorting and gathering area B and drops the bottles letting them fall in a vertical position into a carrier 12 located in the packing station G, where the centering device 20 (not shown in FIG. 3) is arranged. The array of bottles is arranged in two parallel rows of three bottles each, in a pattern that corresponds to the particular carrier 12 in which the bottles are to be packed.

Designated at 21, 22 in FIG. 4 are two parallel longitudinal side boards, transversely spaced from one another. The side boards delimit laterally a path for the carriers 12 placed on the belt conveyor F.

In representative embodiments the centering device 20 comprises two rows of flexible tabs 23, 24, adapted to guide the movement of descent of the bottles, centering them each in a respective carrier cell. Each row 23, 24 of the flexible tabs is mounted along a respective one of a pair of parallel longitudinally extending rotatable shafts 25, 26.

Figure 11:
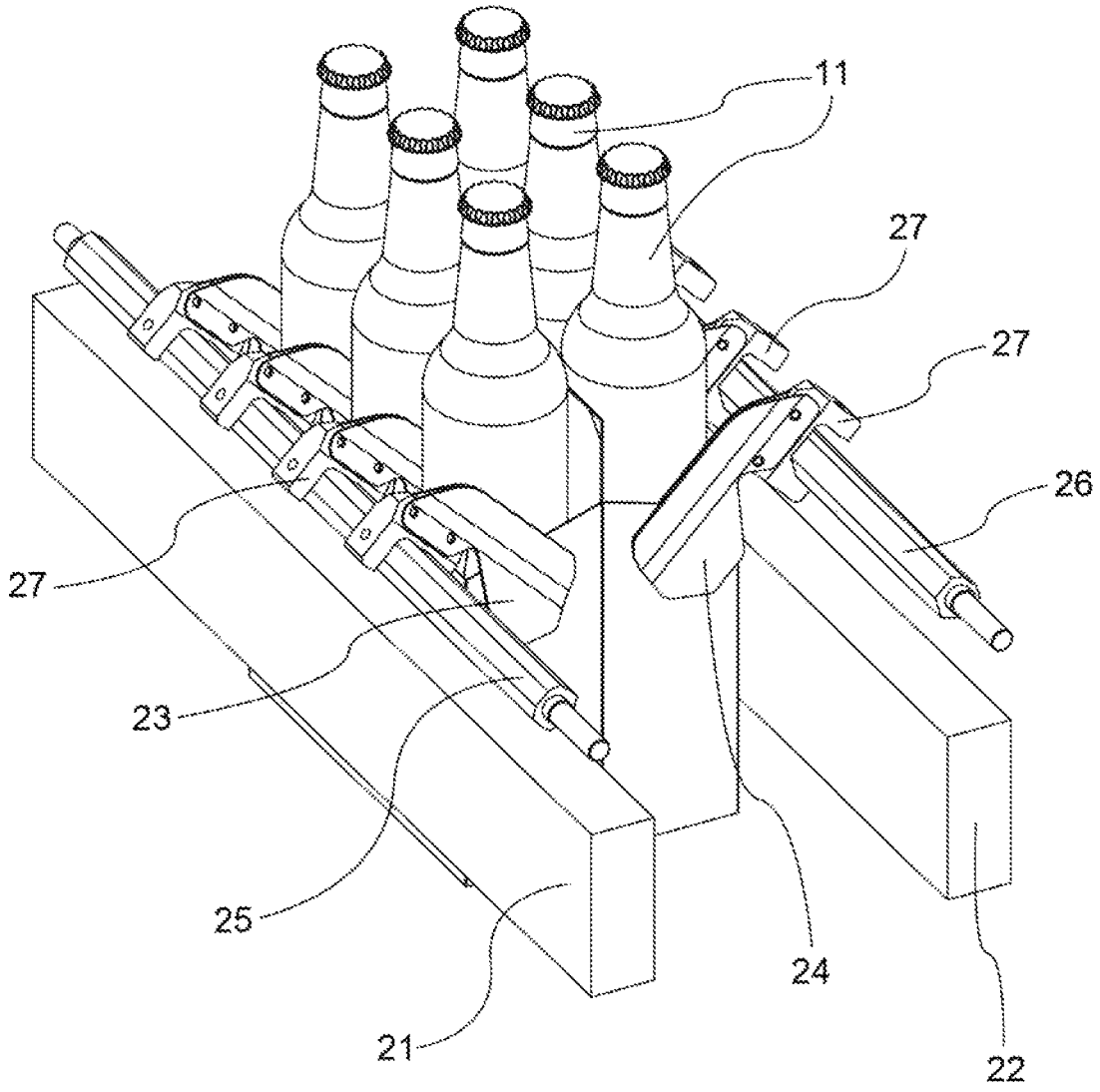
Figure 12:
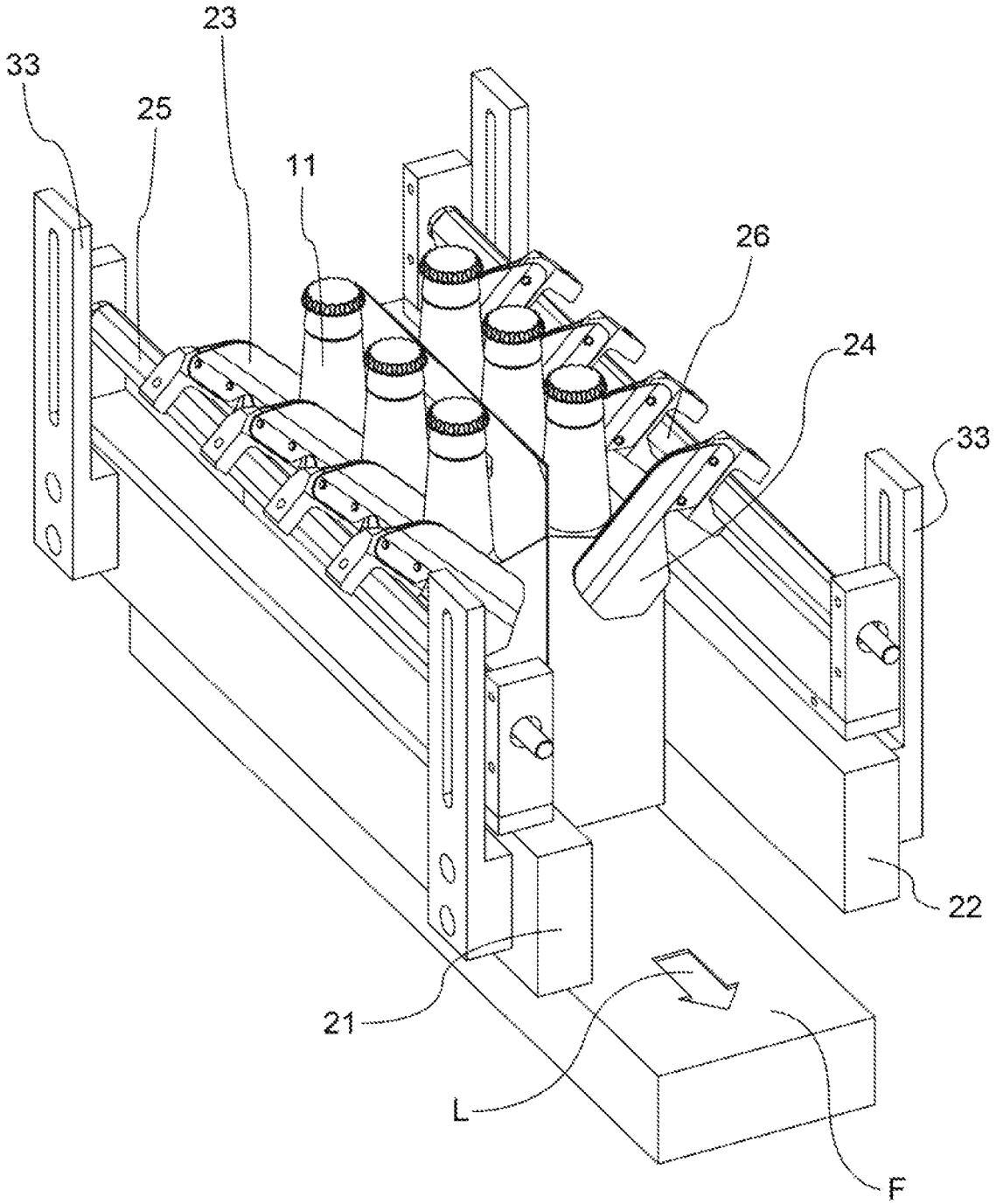
Figure 13:
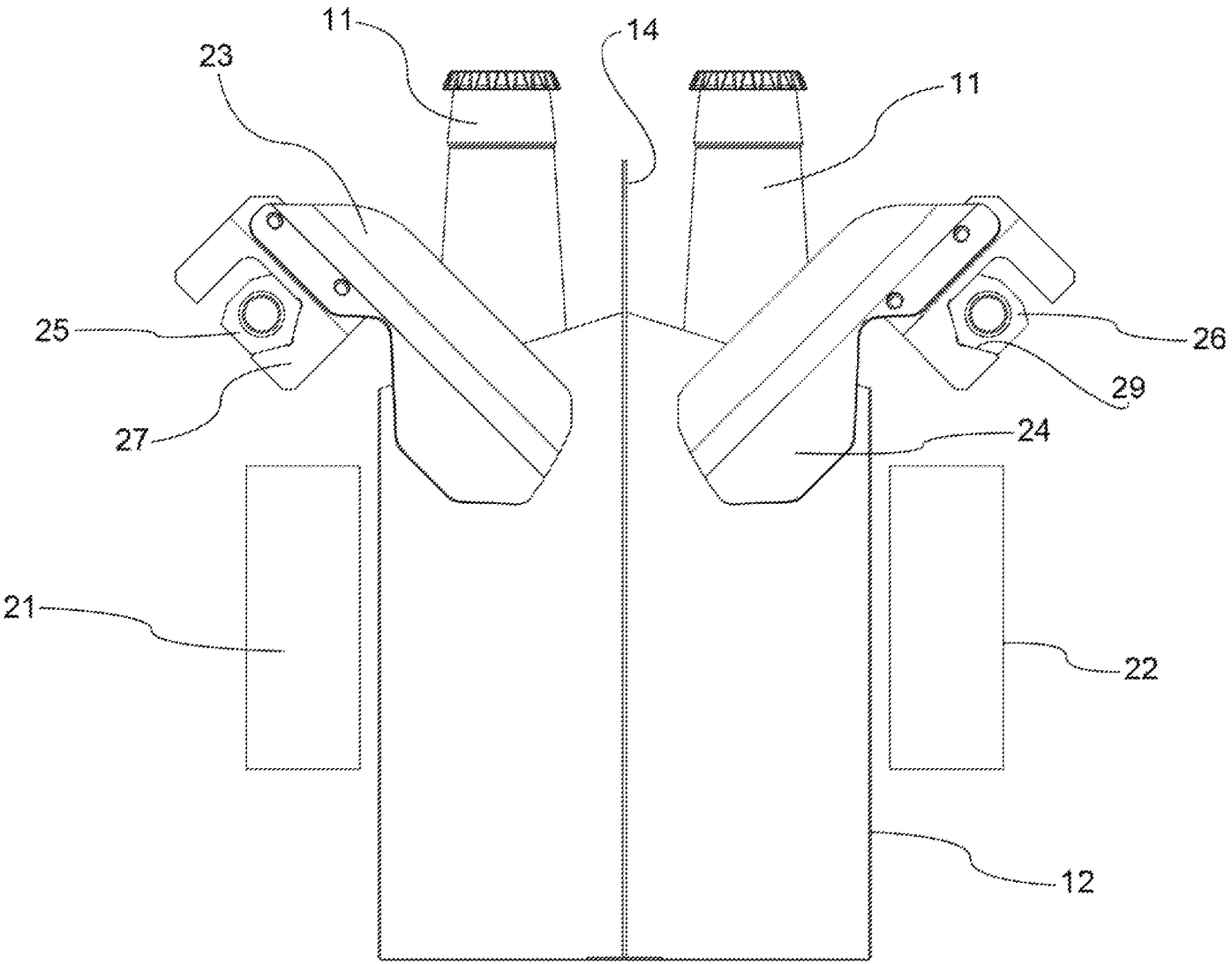
FIG. 13 is a front view of the carrier and a centering device in the arrangement of FIG. 12.
Figure 14:
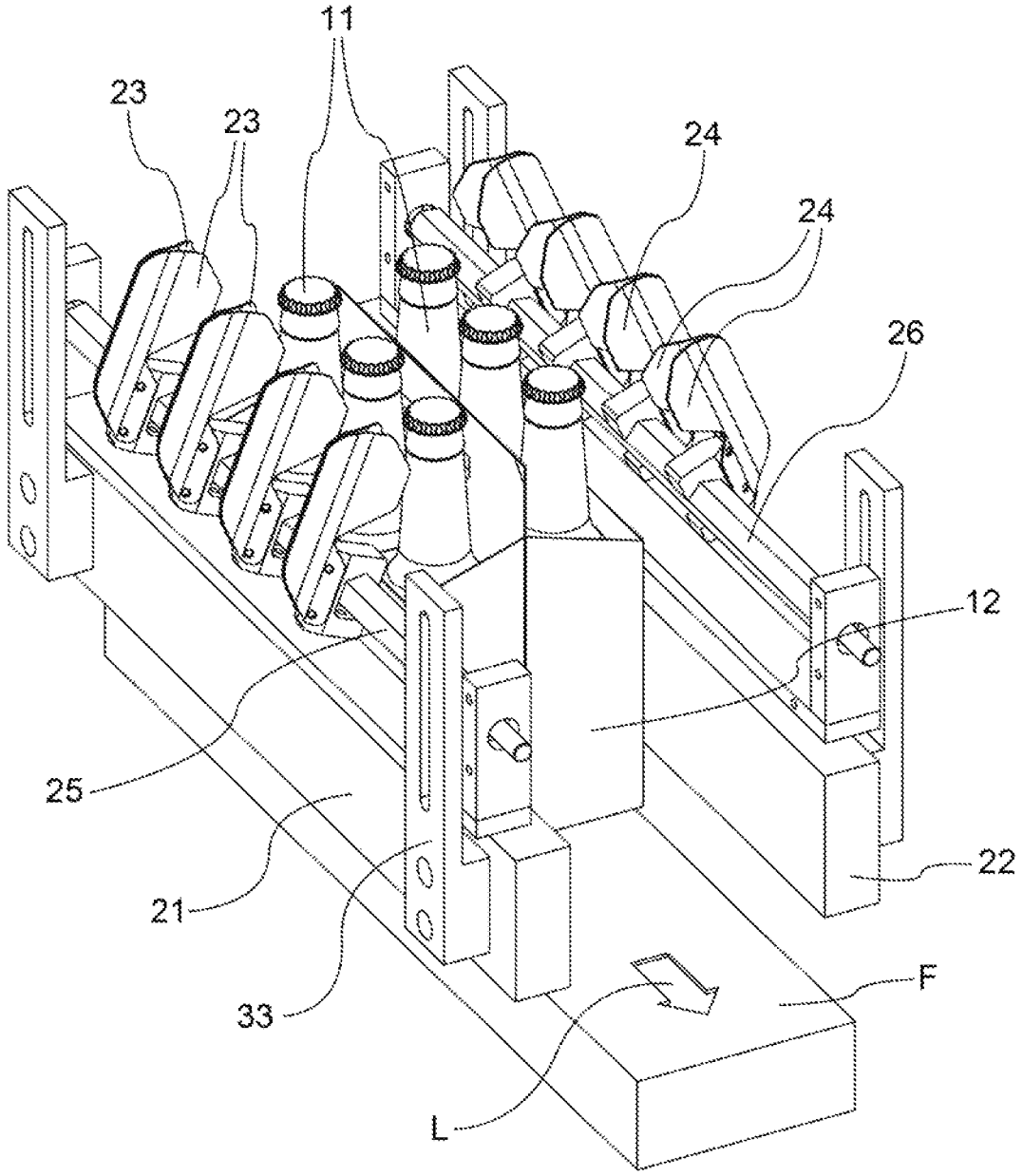
FIGS. 14 and 15 are respectively a perspective view and a front view showing the bottles fitted in the carrier with the tabs of a centering device raised.

The shafts 25, 26 are rotatable simultaneously to bring the tabs 23, 24 alternately in an angular position or lowered engagement condition, in which the tabs are introduced partly in the top parts of the carrier cells (FIGS. 10-12), and an angularly raised position or disengagement condition (FIG. 14), wherein the tabs are rotated away so as not to interfere with the bottle necks to be removed by the conveyor F along with the carrier in which the bottles have been placed.

In the illustrated example, the shafts 25, 26 are placed along two opposite and transversely facing sides of the loading or packing station G, above the longitudinal side boards 21, 22 which delimit the path of the carriers 12.

In certain embodiments, the tabs 23, 24 are mounted on each shaft 25, 26 in pairs of adjacent tabs, wherein the two tabs of each pair of adjacent tabs are diverging downwards. In this way, each bottle is guided toward the center of the cell by two flaps converging towards the center of the cell and belonging to two consecutive pairs of tabs.

In certain embodiments, tabs 23, 24 may be made out of foils or sheets of flexible plastic material.

The two tabs of each pair may have upper adjacent edges 28 which, in the angularly lowered position, are arranged astride or bridging over the upper edges 19 of transverse partitions 15 of the carrier and the front and rear walls 13*b*, 13*c*, favoring the downward sliding of the bottles to the cells.

In certain embodiments, the two adjacent tabs of a same pair, intended to be inserted into two respective contiguous cells, have their adjacent upper edges 28 defining together a ridge which, in the angularly lowered position of insertion, is inclined downwardly toward the bottom of the carrier. This arrangement favors the sliding of individual bottles and their gradual introduction into the cells.

In the illustrated embodiments, the tabs are fixed in pairs to a rigid block 27 which is locked angularly and longitudinally of the respective shaft. The shafts may have a cross section with at least one flat face, in order to facilitate an accurate angular alignment of all the tabs mounted on a same shaft, and to keep more precisely the angular orientation between each tab relative to the supporting shaft. In the illustrated example, the shafts 25, 26 have polygonal transversal cross-sections, particularly hexagonal cross-section. Alternatively, the shafts 25, 26 may have a square section, or have a circular cross-section with one or more flat surfaces. In the illustrated embodiment, the rigid blocks 27 provide a mounting seat 29 of polygonal or flattened shape, at least partially complementary with the cross-sectional shape of the shafts.

Figure 5:
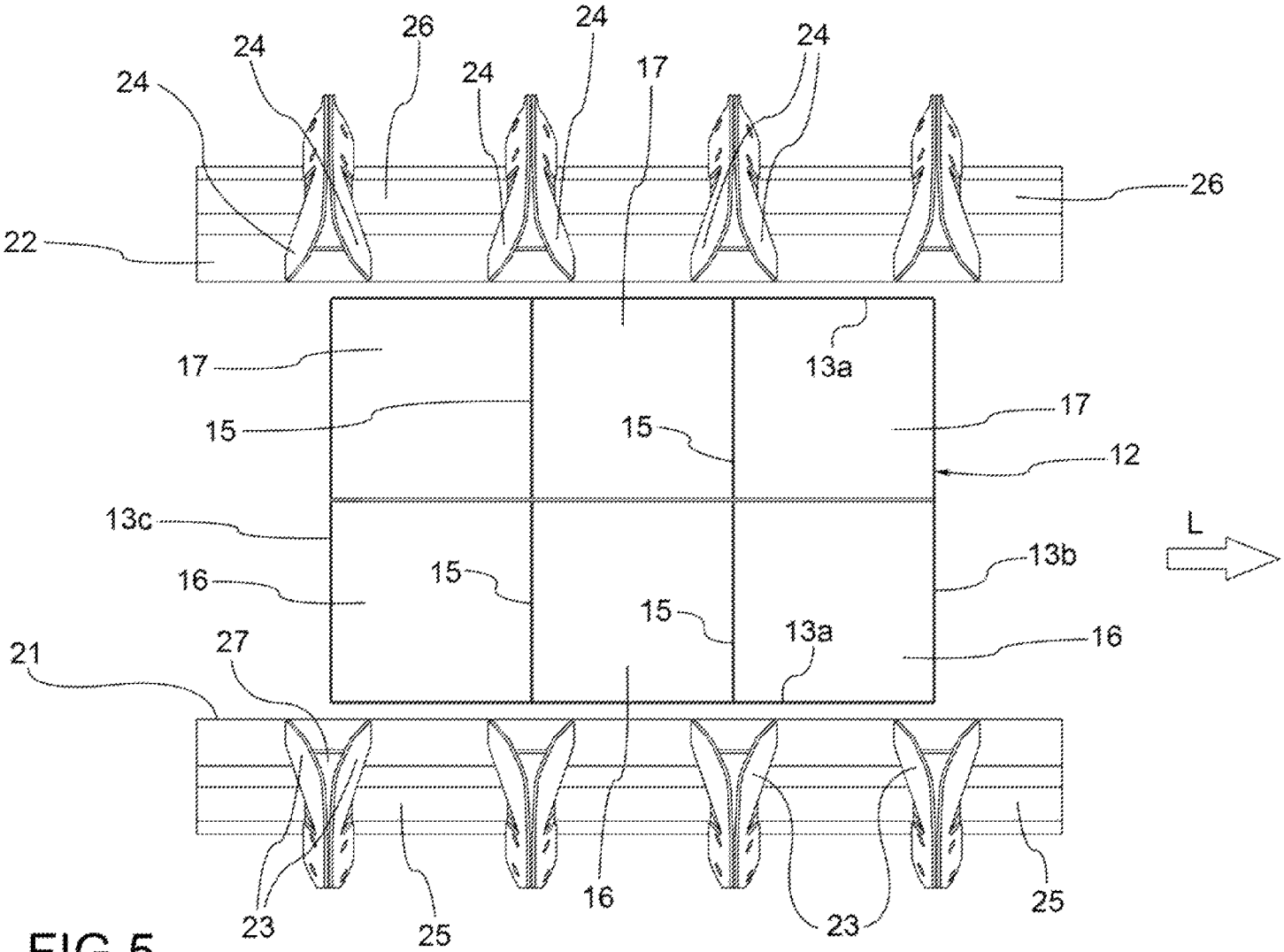
Figure 6:
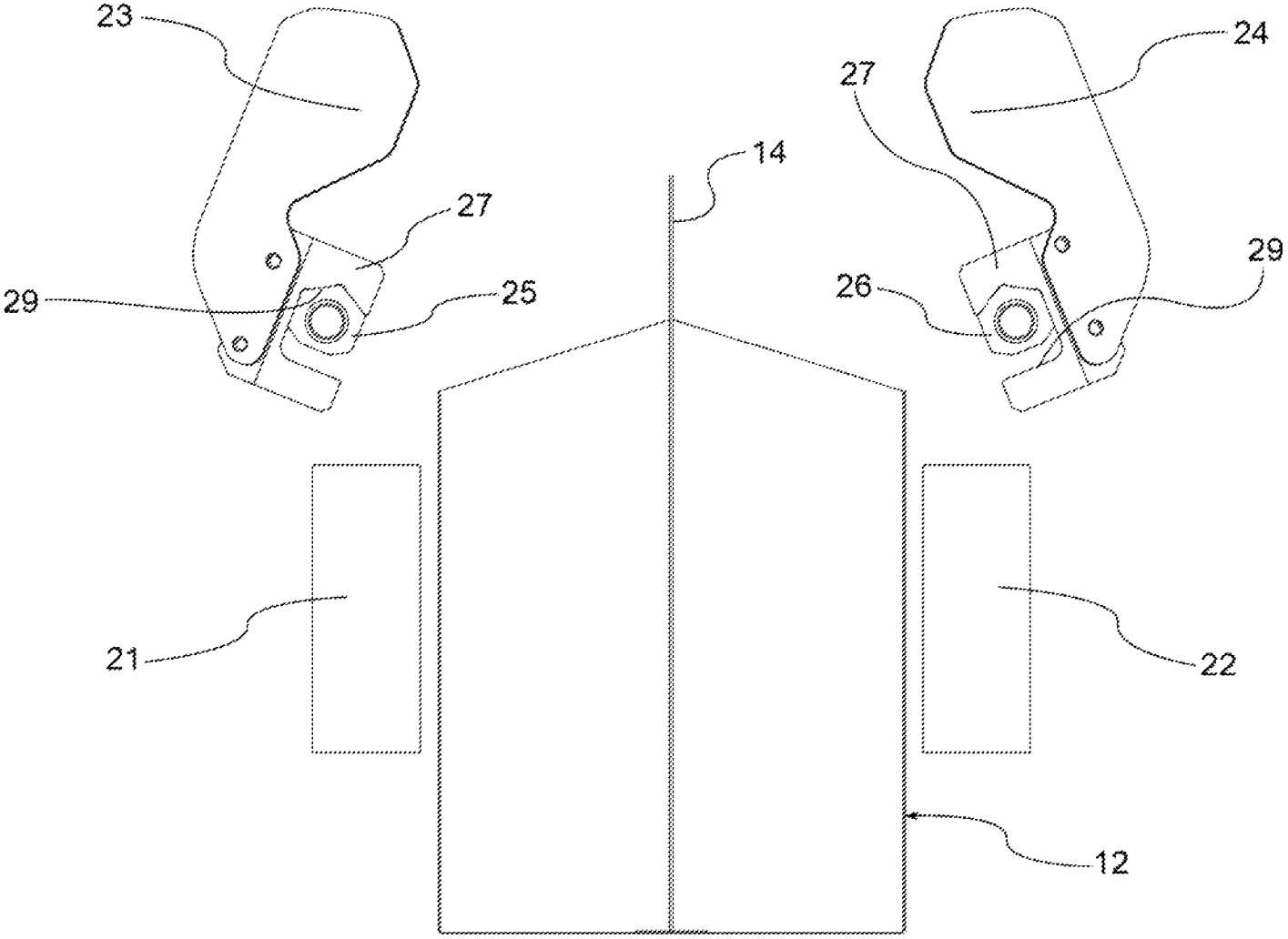
Figure 7:
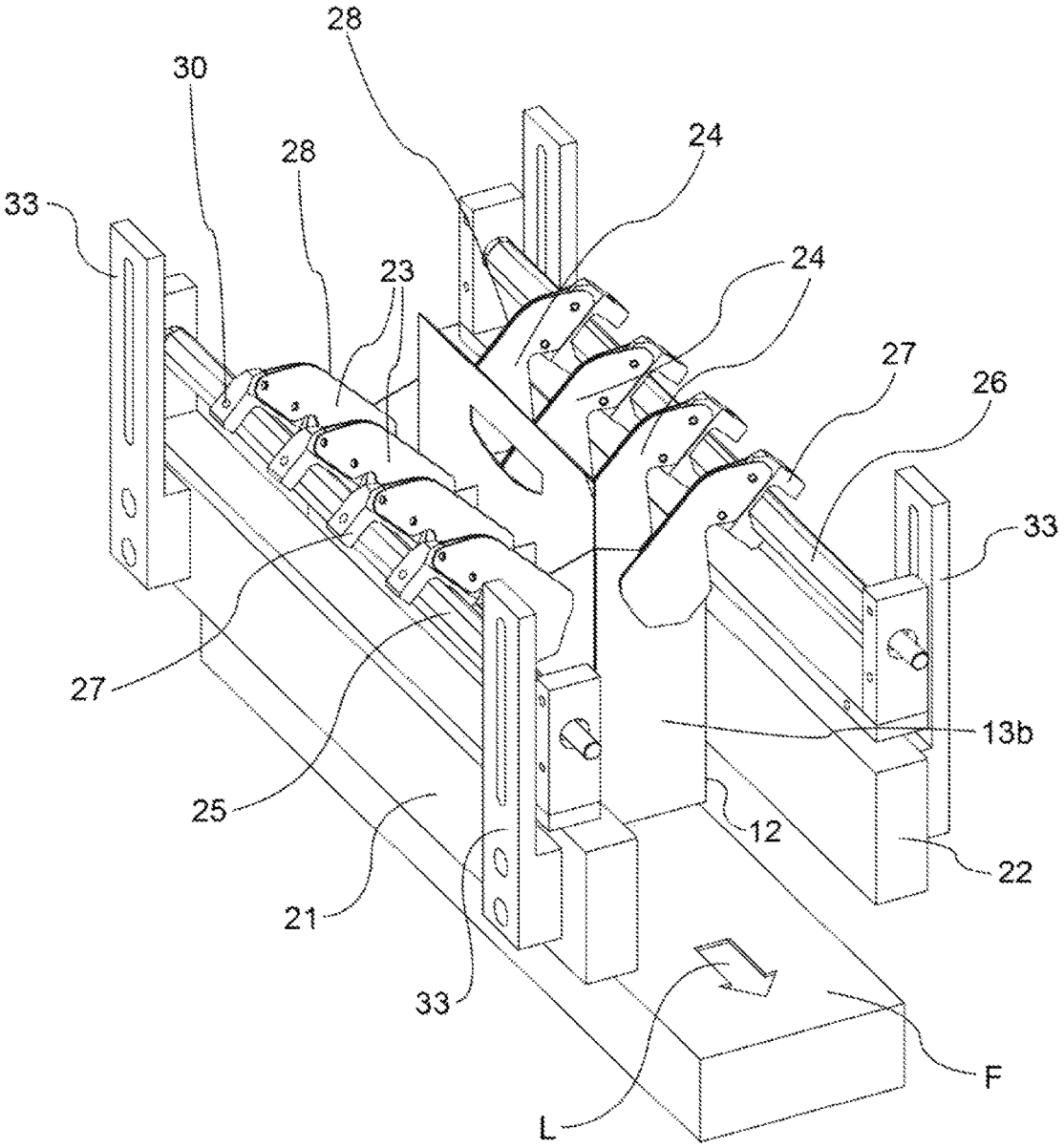
FIGS. 7, 8 and 9 are respectively, a perspective view, a top view and a front view of an empty carrier and a centering device with the tabs in a lowered position.
Figure 8:
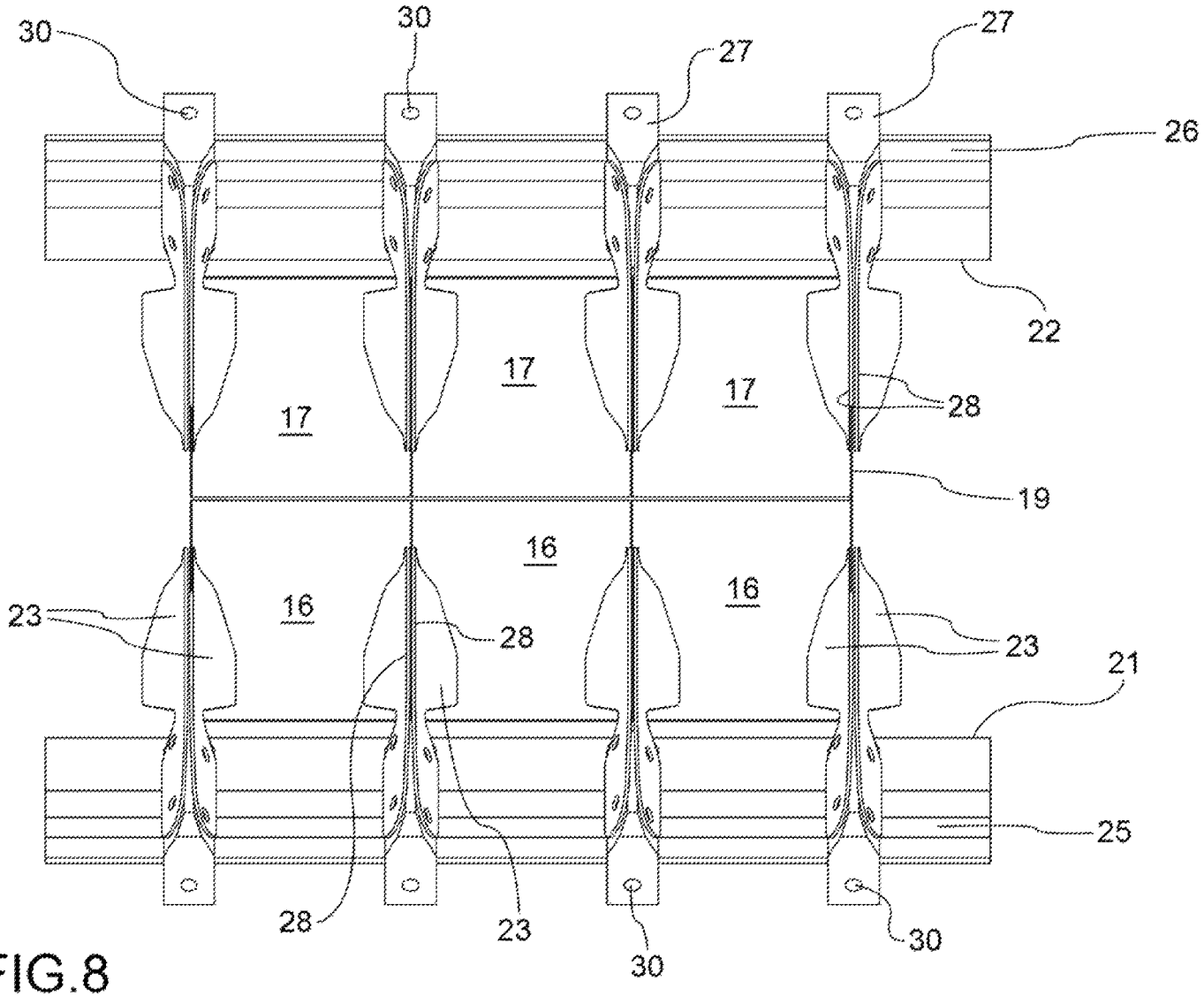
Figure 9:
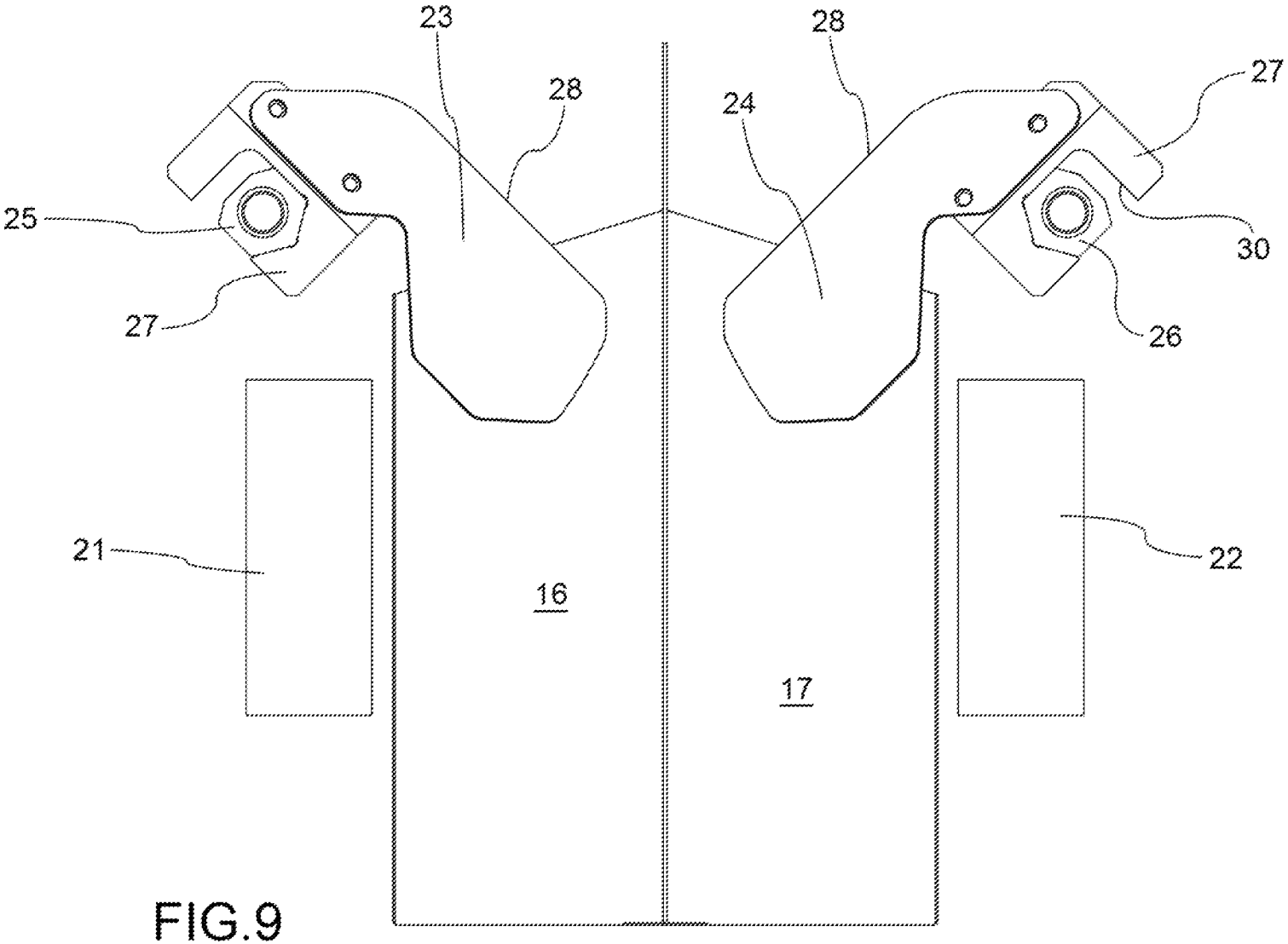
Figure 15:
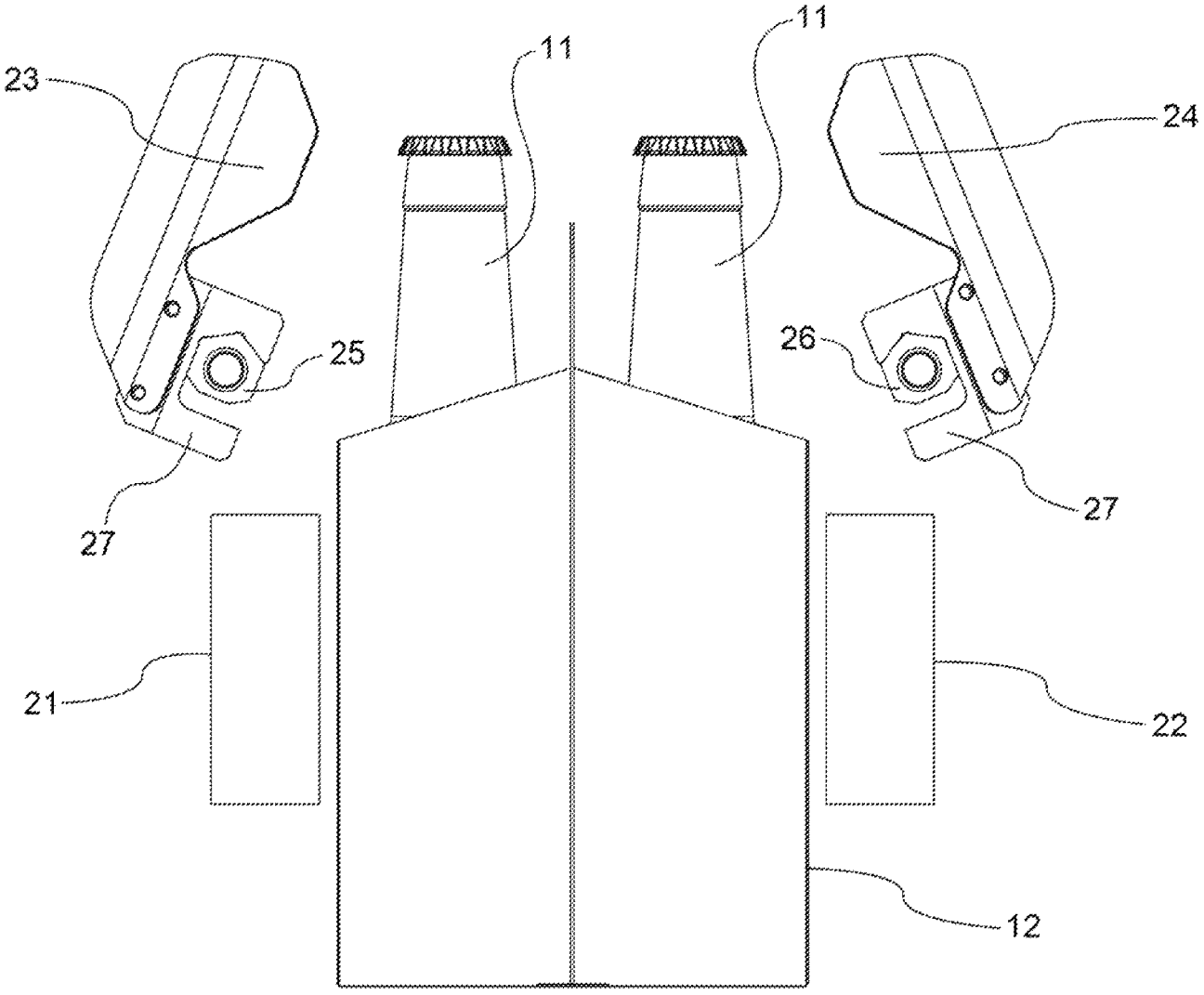
Figure 17:
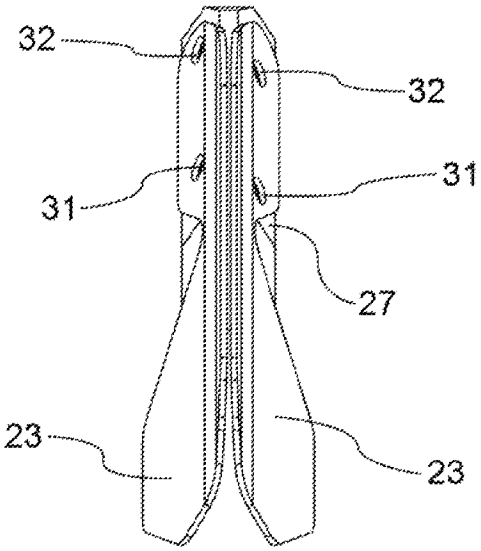
FIGS. 16 to 19 are views of the tabs of a centering device.
Figure 18:
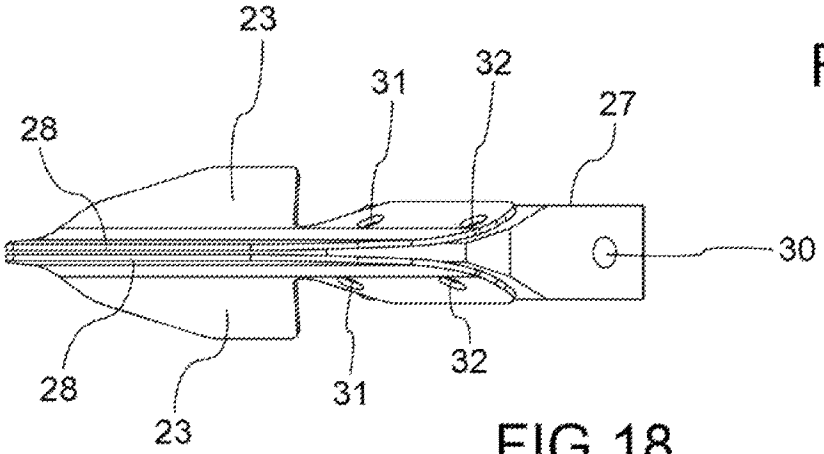
Figure 16:
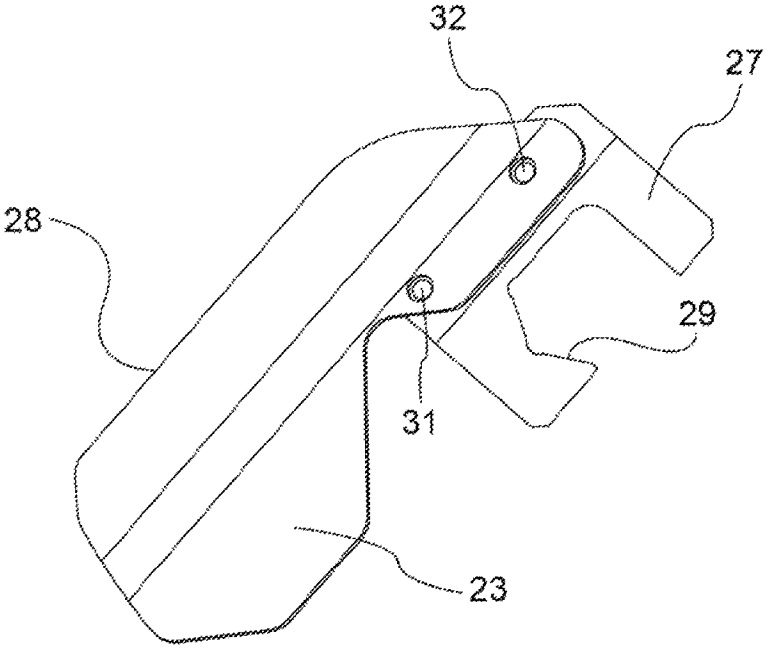
Figure 19:
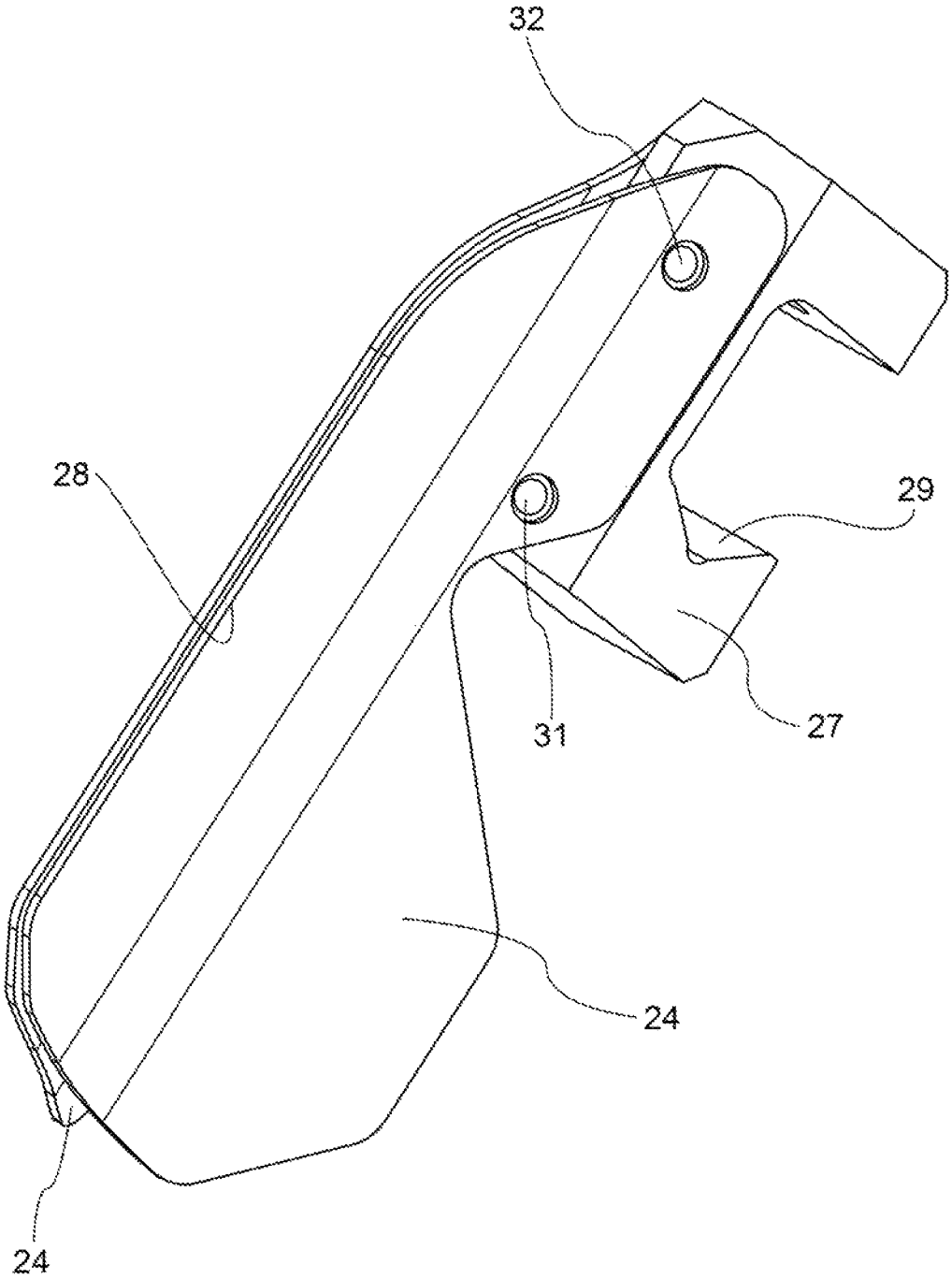

The sequence illustrated in the Figures provides that at first a carrier 12 arrives in the loading or packing station, with the flaps all rotated in the raised position (FIGS. 4-6). The carrier is moved by the conveyor belt and may be temporarily stopped in the loading station by a movable detent (not shown). Alternatively, the movement of the conveyor may be stopped for predetermined loading intervals. Then, the tabs are rotated in the lowered position (FIGS. 7-9), penetrating partially in the top parts of the cells 16, 17. The bottles 11 are inserted from above, and guided in the cells 16, 17 of the tabs 23, 24 (FIGS. 10-13). Once the carrier is packed, the tabs are rotated upwards again (FIGS. 14-15) and the full carrier is taken away by the conveyor belt.

The longitudinal position of the blocks 27 may be adjustable. In the illustrated example, the blocks 27 each have a transverse seat 30 for a screw or other transversely extending fastening element device which releasably and temporarily locks the block to its shaft and secures the block in a different longitudinal position along the same shaft, depending on the width of the bottles or their mutual distance in the longitudinal direction.

To adapt the centering device to different formats of carriers and containers (or bottles) 11, the shafts 25, 26 may be height adjustable by vertically extendible upright supports 33 which sustain the opposite ends of the shafts. The two side boards 21, 22 also may be moved away or toward each other in the transversal direction, depending on the width of the carrier.

The centering device may be adjusted, appropriately spacing the tabs in two or more longitudinally spaced groups of tabs, in order to simultaneously pack more than one carrier in a same loading cycle.

To ensure the angular orientation of each tab relative to the shaft on which it is mounted, each tab may be fixed to the block 27 at two distinct points 31, 32, for example by screws or other fasteners.

According to a further embodiment (not shown), the two tabs of each pair of adjacent tabs may be formed together as a single piece having a V-shaped section with two radiused flaps downwardly diverging toward the centers of two contiguous cells.

As will be appreciated, the invention provides centering devices which are particularly compact and which allow to operate the insertion of bottles at high speed due to the low inertia of the centering tabs which can be rotated quickly out of the carrier, releasing it.

Experimental tests carried out by the Applicant show that the invention provides excellent results in terms of speed, eliminating the times needed for the ascent and the descent of conventional centering devices with fingers. Centering devices according to the invention are reliable and cut down on idle time due to the jamming of conventional fingers with the carriers, particularly with carriers having small-sized cells.

Various aspects and embodiments of centering devices have been described. It is understood that each embodiment may be combined with any other embodiment. The invention is not limited to the embodiments described but may be varied by a person skilled in the art and still fall within the scope of the invention as defined by defined by the appended claims and in light of the specification.

What is claimed is:

1. A centering device provided with flexible tabs for directing containers being inserted into respective cells of a carrier having an upwardly open outer box with a rectangular base, a median vertical partition extending in a longitudinal direction, and one or more vertical internal partitions extending in a transversal direction, so as to define, within the carrier, two parallel rows of upwardly open cells, the centering device comprising a first and a second shaft parallel to one another, extending longitudinally and transversely spaced from one another, a first and a second row of flexible tabs mounted along the first and the second shafts;

the shafts being rotatable to rotate simultaneously all the tabs between two alternative angular positions:

a lowered angular position, in which the tabs of the first row are introduced partially in respective top parts of the cells of a first row of cells of the carrier, and the tabs of the second row of tabs are partially introduced in respective top parts of the cells of the second row of cells, in order to guide the containers toward the centers of the cells, and a raised angular position, in which all the tabs are rotated away so as not to interfere with the containers which have to be taken away along with the carrier in which they are placed.

2. The device of claim 1, wherein the tabs are mounted on each shaft in pairs of adjacent tabs, wherein two tabs of each pair of adjacent tabs are downwardly diverging.

3. The device of claim 2, wherein the two tabs of each pair of contiguous tabs have upper edges which, in the angularly lowered position, are arranged astride upper edges of the transversal partitions of the carrier.

4. The device of claim 2, wherein the two tabs of each pair of adjacent tabs have upper edges which, in the angularly lowered position, are inclined downward.

5. The device of claim 1, wherein the shafts each have a cross section having at least one flat face.

6. The device of claim 5, wherein the tabs are fixed to rigid blocks each providing a seat having a shape at least partially matching a cross section of one of the shafts, and each block provides a seat or an element for releasably fastening to one of the shafts in order to adjust the longitudinal position of the blocks and the tabs along the shafts.

7. The device of claim 1, further comprising two parallel, longitudinal side boards, transversely spaced apart and facing each other, to delimit laterally a length of a path for the carriers, wherein each shaft is arranged substantially above one of the two side boards.

8. The device of claim 1, wherein the shafts are supported by height adjustable supporting elements.

9. A carrier packer comprising the centering device of claim 1.

* * * * *